US006530845B1

(12) United States Patent
Corbett

(10) Patent No.: US 6,530,845 B1
(45) Date of Patent: Mar. 11, 2003

(54) GOLF SWING PLANE TRAINER

(76) Inventor: William W. Corbett, 1001 E. 65th St., Inglewood, CA (US) 90302

( * ) Notice: Subject to any disclaimer, the term of this patent is extended or adjusted under 35 U.S.C. 154(b) by 0 days.

(21) Appl. No.: 09/564,733

(22) Filed: May 4, 2000

(51) Int. Cl.[7] ..... A63B 57/00; A63B 69/36
(52) U.S. Cl. ..... 473/223; 473/219; 473/226
(58) Field of Search ..... 473/199, 219, 473/226, 228, 229, 230, 231, 235, 236, 238, 242, 243, 249, 256, 257, 263, 266, 269, 329, 519; 446/240, 266, 484; 273/412

(56) References Cited

U.S. PATENT DOCUMENTS 3,945,646 A 3/1976 Hammond
4,582,325 A 4/1986 Yuhara
4,991,850 A 2/1991 Wilhlem
5,082,283 A 1/1992 Conley et al.
5,209,483 A 5/1993 Gedney et al.
5,332,225 A 7/1994 Ura
5,941,779 A * 8/1999 Zeiner-Gundersen ..... 473/224

* cited by examiner

*Primary Examiner*—Paul T. Sewell
*Assistant Examiner*—Alvin A. Hunter, Jr.

(57) ABSTRACT

A golf swing aid for coupling to a golf club having a shaft having a head on a bottom end thereof and a free top end. The golf swing aid includes a gyro assembly adapted for mounting on the golf club such that a user feels a sensation upon the golf club being swung improperly. The gyro assembly may be removably attached to the golf club, such as the top end thereof, and may further be rotatably and swivelly mounted on the golf club so as to allow a shaft of the gyro assembly to remain vertical during the swing.

7 Claims, 5 Drawing Sheets

GOLF SWING PLANE TRAINER

BACKGROUND OF THE INVENTION

1. Field of the Invention

The present invention relates to golf swing aids and more particularly pertains to a new golf swing plane trainer for affording a sensation when a golf club is swung improperly, thereby prompting corrective action.

2. Description of the Prior Art

The use of golf swing aids is known in the prior art. More specifically, golf swing aids heretofore devised and utilized are known to consist basically of familiar, expected and obvious structural configurations, notwithstanding the myriad of designs encompassed by the crowded prior art which have been developed for the fulfillment of countless objectives and requirements.

Known prior art golf swing aids include U.S. Pat. No. 3,945,646; U.S. Pat. No. 5,209,483; U.S. Pat. No. 5,082,283; U.S. Pat. No. 4,582,325; U.S. Pat. No. 5,332,225; and U.S. Pat. No. 4,991,850.

In these respects, the golf swing plane trainer according to the present invention substantially departs from the conventional concepts and designs of the prior art, and in so doing provides an apparatus primarily developed; for the purpose of affording a sensation when a golf club is swung improperly, thereby prompting corrective action.

SUMMARY OF THE INVENTION

In view of the foregoing disadvantages inherent in the known types of golf swing aids now present in the prior art, the present invention provides a new golf swing plane trainer construction wherein the same can be utilized for affording a sensation when a golf club is swung improperly, thereby prompting corrective action.

The general purpose of the present invention, which will be described subsequently in greater detail, is to provide a new golf swing plane trainer apparatus and method which has many of the advantages of the golf swing aids mentioned heretofore and many novel features that result in a new golf swing plane trainer which is not anticipated, rendered obvious, suggested, or even implied by any of the prior art golf swing aids, either alone or in any combination thereof.

To attain this, the present invention is adapted for use with a golf club having a shaft with a head on a bottom end thereof and a free top end. A mount including a cap defined by a top face and a flexible peripheral side wall coupled to a periphery of the top face and extending therefrom. As such, an interior space and an open bottom are defined for receiving the top end of the shaft of the golf club. The top face of the mount has a post fixedly coupled thereto which extends upwardly therefrom in coaxial relationship with the shaft of the golf club. Also included is a housing constructed from a transparent material. As shown in FIG. 2, the housing includes a hollow lower hemisphere. Further, a member is fixedly coupled to an apex of the lower hemisphere and extending therefrom in coaxial relationship therewith. Such member is further pivotally connected to the post of the mount. The housing further includes a hollow upper hemisphere snappily connected to the lower hemisphere to define a full sphere. The lower and upper hemispheres further include an annular recess formed in an interior surface thereof, wherein the annular recess resides within a plane which includes an axis of the post and member. As best shown in FIGS. 2 & 3, a gyro assembly is shown to include a shaft having a stator fixedly mounted on a central extent thereof. A rotor is rotatably mounted about the stator for rotating with respect to the stator upon the receipt of power. A substantially orb-shaped flywheel is mounted on the rotor about an axis which coincides with the shaft. As best shown in FIG. 3, a pair of cylindrical batteries are mounted on diametrically opposed points on the flywheel about axes which are parallel with the shaft. A reed switch is mounted on the gyro assembly. Such reed switch is further connected between the batteries and the rotor for supplying power to the rotor and rotating the flywheel upon the closing thereof. Finally, the gyro assembly includes an annular slider ring. Ends of the shaft of the gyro assembly are coupled to diametrically opposed points thereon. As such, the flywheel of the gyro assembly rotates about an axis which remains in perpendicular relationship with an axis about which the slider ring is formed. In use, the gyro assembly is removably situated within the housing. When the gyro assembly is situated in the proximity of a magnetic slider, the reed switch of the gyro assembly is adapted to close and the flywheel spins. As such, a user feels a sensation upon the golf club being swung improperly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new golf swing plane trainer apparatus and method which has many of the advantages of the golf swing aids mentioned heretofore and many novel features that result in a new golf swing plane trainer which is not anticipated, rendered obvious, suggested, or even implied by any of the prior art golf swing aids, either alone or in any combination thereof.

It is another object of the present invention to provide a new golf swing plane trainer which may be easily and efficiently manufactured and marketed.

It is a further object of the present invention to provide a new golf swing plane trainer which is of a durable and reliable construction.

An even further object of the present invention is to provide a new golf swing plane trainer which is susceptible of a low cost of manufacture with regard to both materials and labor, and which accordingly is then susceptible of low prices of sale to the consuming public, thereby making such golf swing plane trainer economically available to the buying public.

Still yet another object of the present invention is to provide a new golf swing plane trainer which provides in the apparatuses and methods of the prior art some of the advantages thereof, while simultaneously overcoming some of the disadvantages normally associated therewith.

Still another object of the present invention is to provide a new golf swing plane trainer for affording a sensation when a golf club is swung improperly, thereby prompting corrective action.

Even still another object of the present invention is to provide a new golf swing plane trainer that is adapted for use with a golf club having a shaft with, a head on a bottom end thereof and a free top end. Also included is a gyro assembly mounted on the free top end of the golf club. As such, a user feels a sensation upon the golf club being swung improperly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
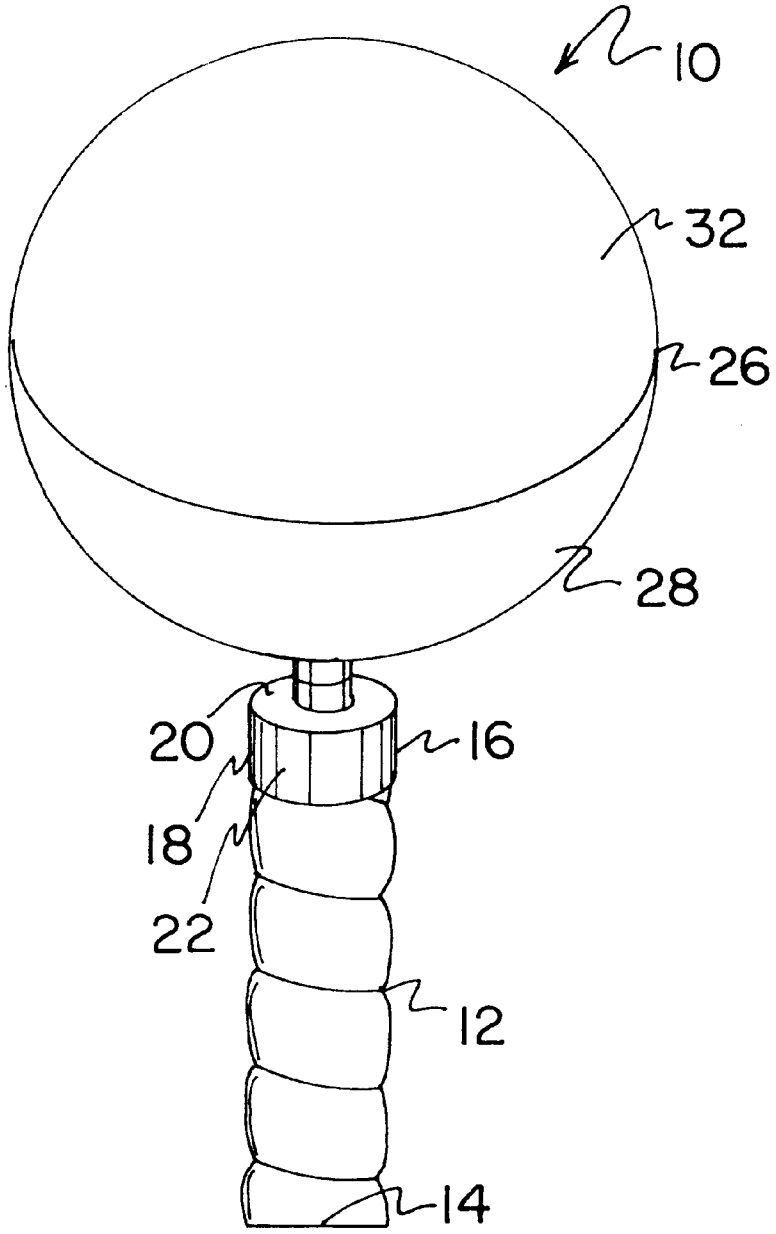
FIG. 1 is a perspective view of a new golf swing plane trainer according to the present invention.

With reference now to the drawings, and in particular to FIGS. 1 through 8 thereof, a new golf swing plane trainer embodying the principles and concepts of the present invention and generally designated by the reference numeral 10 will be described.

The present invention, designated as numeral 10, is adapted for use with a golf club 12 having a shaft 14 with a head on a bottom end thereof and a free top end.

FIG. 1 shows a mount 16 including a cap 18 defined by a top face 20 and a flexible peripheral side wall 22 coupled to a periphery of the top face and extending therefrom. As such, an interior space and an open bottom are defined for receiving the top end of the shaft of the golf club. For securing the cap onto the golf club, a fastener or clamp preferably encompasses the peripheral side wall of the cap for reducing a diameter thereof. This may be accomplished by way of a piece of deformable metal, a strip of pile fastener, or the like. The top face of the mount has a post 24 fixedly coupled thereto which extends upwardly therefrom in coaxial relationship with the shaft of the golf club.

Figure 2:
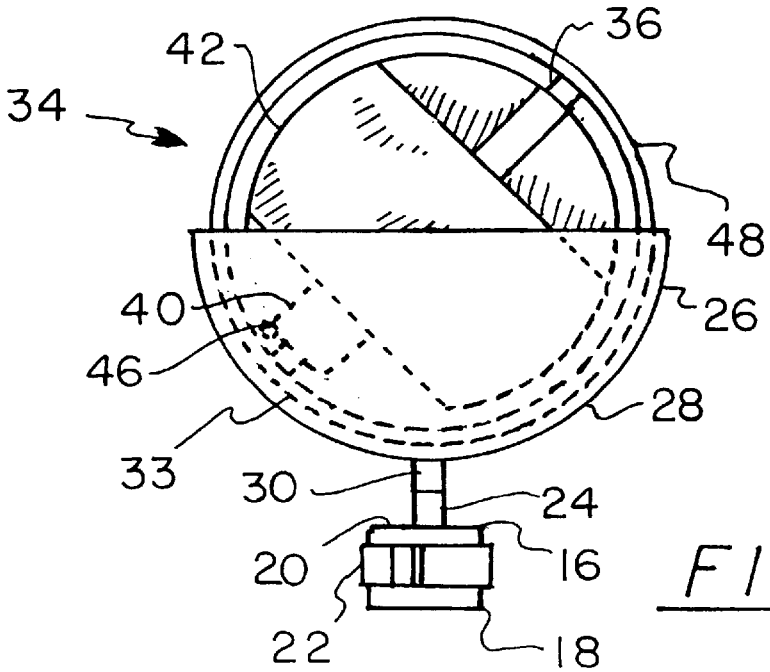
FIG. 2 is a side view off the present invention.

Also included is a housing 26 constructed from a transparent material. As shown in FIG. 2, the housing includes a hollow lower hemisphere 28. Further, a member 30 is fixedly coupled to an apex of the lower hemisphere and extends therefrom in coaxial relationships therewith. Such member is further pivotally connected to the post of the mount about a single axis. The housing further includes a hollow upper hemisphere 32 snappily connected to the lower hemisphere to define a full sphere. An annular groove may be employed to afford such snap coupling. The lower and upper hemispheres further include an annular recess 33 formed in an interior surface thereof, wherein the annular recess resides within a plane which includes an axis of the post and member.

Figure 3:
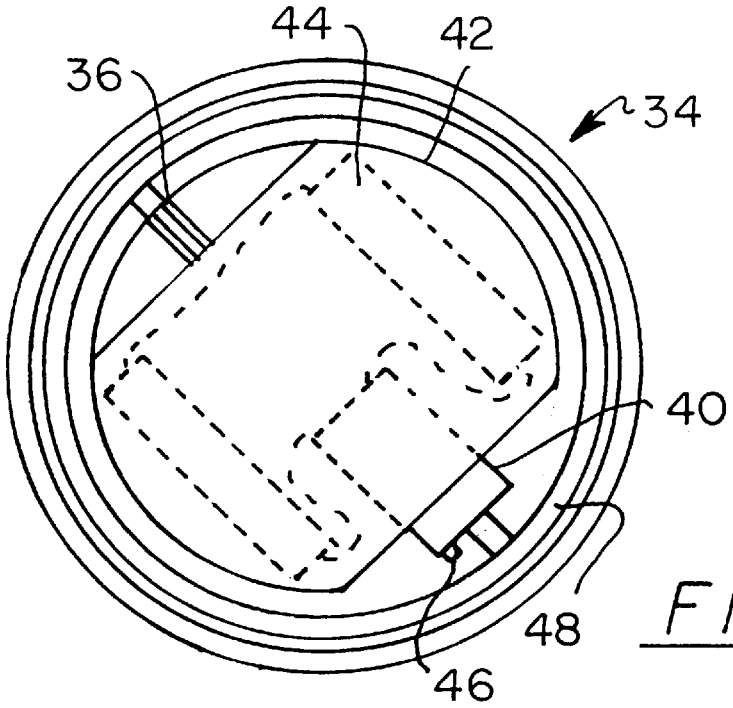
FIG. 3 is a bottom view of the gyro assembly of the present invention taken along line 3—3 shown in FIG. 2.

As best shown in FIGS. 2 & 3, a gyro assembly 34 is shown to include a shaft 36 having a stator 38 fixedly mounted on a central extent thereof. A rotor 40 is rotatably mounted about the stator for rotating with respect to the stator upon the receipt of power. In the context of the present description, the rotator preferably comprises a plurality of wrapped coils while the stator comprises of magnets. It should be noted that just the opposite may be accomplished with sliding annular or brush contacts, as will soon become apparent. A substantially orb-shaped flywheel 42 is fixedly mounted on the rotor about an axis which coincides with the shaft. As best shown in FIG. 3, a pair of cylindrical batteries 44 are mounted on diametrically opposed points on the flywheel about axes which are parallel with the shaft. A reed switch 46 is mounted on rotor of the gyro assembly adjacent to an end of the shaft. Such reed switch is further connected between the batteries and the rotor for supplying power to the rotor and rotating the flywheel upon the closing thereof.

Figure 4:
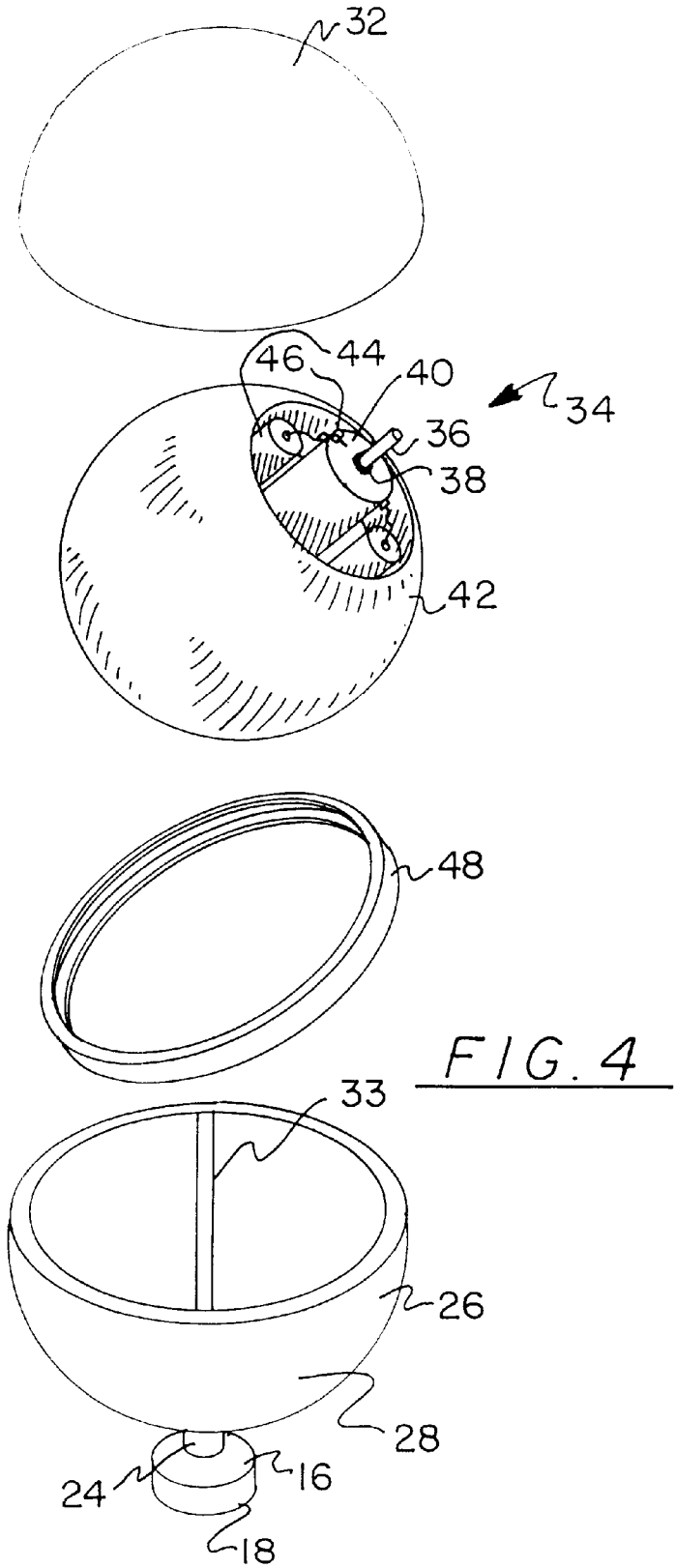
FIG. 4 is an exploded view of the present invention.

Finally, the gyro assembly includes an annular slider ring 48. Side edges of the annular slider ring preferably have inwardly extending lips for defining an inner groove, as shown in FIG. 4. Ends of the shaft of the gyro assembly are fixedly coupled to diametrically opposed points on the slider ring. As such, the flywheel of the gyro assembly rotates about an axis which remains in perpendicular relationship with an axis about which the slider ring is formed.

Figure 5:
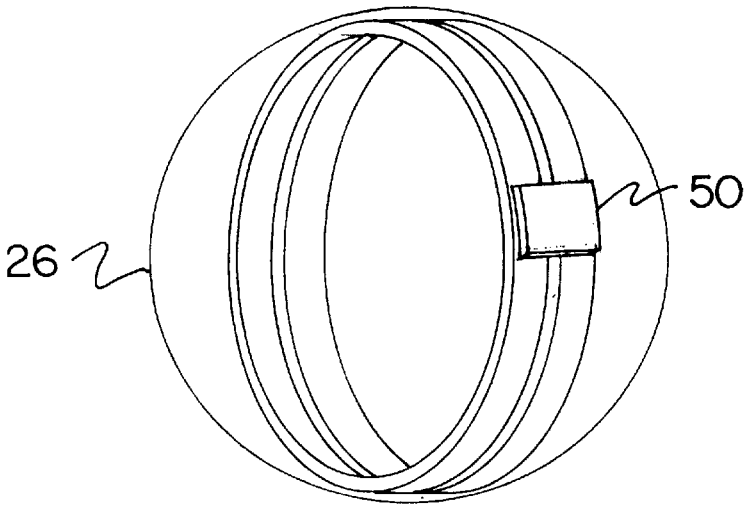
FIG. 5 is a perspective view of the magnet slider of the present invention.

As shown in FIG. 5, a magnetic slider 50 is slidably mounted on an annular groove formed in an exterior surface of the housing in coplanar relationship with the annular recess 33. The magnetic slider is slidable within the proximity of the reed switch of the gyro assembly and further slidable to a position distanced from the reed switch. A T-shaped groove and protrusion combination may be employed to maintain the magnet slider attached to the housing.

In use, the slider ring of the gyro assembly is slidably situated within the annular recess of the interior of the housing. When the magnetic slider is positioned in the proximity of the reed switch of the gyro assembly, the reed switch is adapted to close and the flywheel spins. It should be noted that after the flywheel gains sufficient speed, the magnetic slider may be distanced from the reed switch prior to the golf club being swung. During the swing, a user feels a sensation upon the golf club being swung improperly. In particular, the sensation is noticed when the golf club is swung out of a designed plane.

Prior to the swing when the club is addressing the ball and the flywheel is spinning, the shaft of the gyro assembly is vertically oriented. As the club is cocked, the rotatable coupling between the housing and shaft and the rotatable coupling between the annular slider ring and the housing allows the shaft of the gyro assembly to remain vertically oriented. If, however, the golf club is removed from the swing plane,the user feels a sensation afforded by the gyro assembly.

Figure 8:
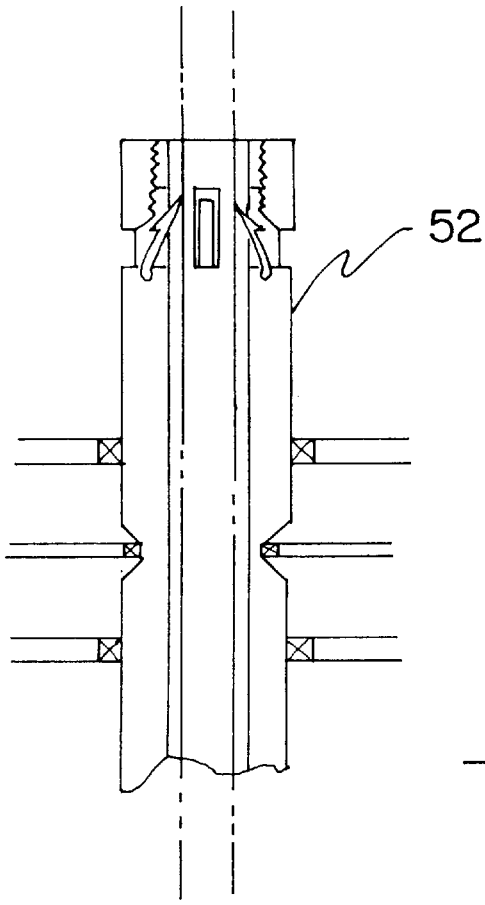
FIG. 8 is a cross-sectional view of the alternate embodiment of the resent invention taken along line 8—8 shown in FIG. 6.
Figure 7:
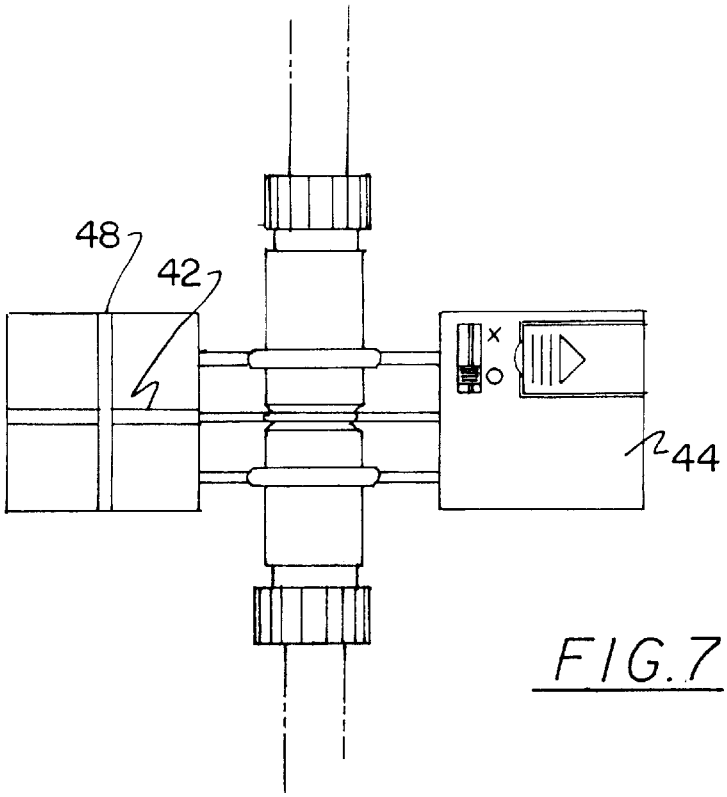
FIG. 7 is a side view of the alternate embodiment of the present invention.
Figure 6:
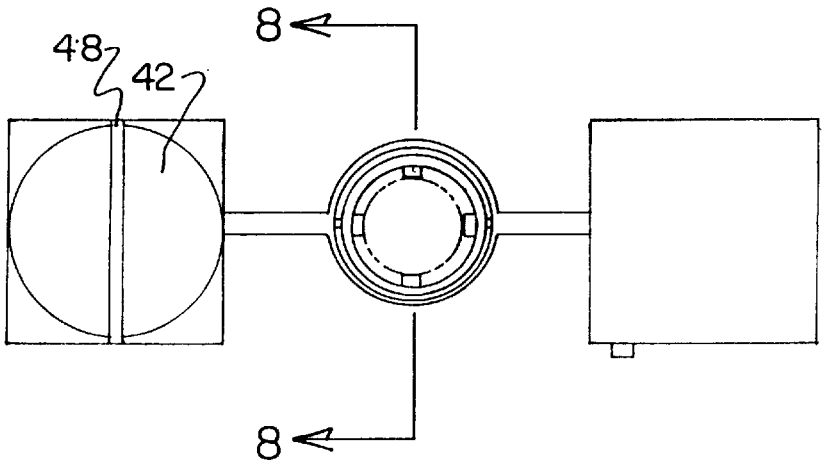
FIG. 6 is a top view of an alternate embodiment of the present invention.

An alternate embodiment of the present invention is shown in FIGS. 6–8. As shown, the batteries are positioned within a housing separate from a housing in which the gyro assembly is positioned. Both housings are rotatably coupled to the golf club shaft via a pair of arms which are rotatably coupled to a sleeve 52. Such sleeve is removably secured to the golf club shaft during use. Annular and brush contacts are used to transfer power to the gyro assembly of the alternate embodiment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf swing aid system comprising:

a golf club including a shaft having a head on a bottom end thereof and a free top end;

a golf swing aid removably mounted on the free top end of the golf club for permitting selective removal of the golf swing aid from the golf club, the golf swing aid comprising:

a mount including a cap defined by a top face and a flexible peripheral side wall coupled to a periphery of the top face and extending therefrom for defining an interior space and an open bottom receiving the free top end of the shaft of the golf club, the top face of the mount having a post fixedly coupled thereto and extending upwardly therefrom in coaxial relationship with the shaft of the golf club;

a housing constructed from a transparent material and including a hollow lower hemisphere, a member fixedly coupled to an apex of the lower hemisphere and extending therefrom in coaxial relationship therewith and further pivotally connected to the post of the mount, the housing further including a hollow upper hemisphere snappily connected to the lower hemisphere to define a full sphere; and a gyro assembly including a shaft having a stator fixedly mounted on a central extent thereof, a rotor rotatably mounted about the stator for rotating with respect to the stator upon the receipt of power, a substantially orb-shaped flywheel mounted on the rotor about an axis which coincides with the shaft of the gyro, a pair of cylindrical batteries mounted on diametrically opposed points on the flywheel about axes which are parallel with the shaft, a reed switch mounted on the gyro assembly and connected between the batteries and the rotor for supplying power to the rotor and rotating the flywheel upon the closing thereof, and an annular slider ring having ends of the shaft coupled to diametrically opposed points thereon such that the flywheel of the gyro assembly rotates about an axis which remains in perpendicular relationship with an axis about which the slider ring is formed;

a magnetic slider mounted on the housing;

wherein the gyro assembly is removably situated within the housing and the reed switch of the gyro assembly is adapted to close upon the gyro assembly being situated in the proximity of the magnetic slider, whereby a user feels a sensation upon the golf club being swung improperly.

2. A golf swing aid system comprising a golf club including a shaft having a head on a bottom end thereof and a free top end;

a golf swing aid removably mounted on the free top end of the golf club for permitting selective removal of the golf swing aid from the golf club, the golf swing aid comprising:

a gyro assembly adapted for mounting on the golf club such that a user feels a sensation upon the golf club being swung improperly; and a mount including a cap defined by a top face and a flexible peripheral side wall coupled to a periphery of the top face and extending therefrom for defining an interior space and an open bottom receiving the free top end of the shaft of the golf club.

3. A golf swing aid system as set forth in claim 2 wherein the top face of the mount has a post fixedly coupled thereto and extending upwardly therefrom in coaxial relationship with the shaft of the golf club.

4. A golf swing aid system as set forth in claim 3 additionally comprising a housing constructed from a transparent material and including a hollow lower hemisphere, a member fixedly coupled to an apex of the lower hemisphere and extending from the apex, the member being in coaxial relationship with the apex and being pivotally connected to the post of the mount, the housing further including a hollow upper hemisphere connected to the lower hemisphere to define a sphere.

5. A golf swing aid system as set forth in claim 4 wherein the gyro assembly includes a shaft having a stator fixedly mounted on a central extent thereof, a rotor rotatably mounted about the stator for rotating with respect to the stator upon the receipt of power, a substantially orb-shaped flywheel mounted on the rotor about an axis which coincides with the shaft of the gyro, at least one battery mounted on the flywheel, a reed switch being mounted on the gyro assembly and connected between the batteries and the rotor for supplying power to the rotor and rotating the flywheel upon the closing of the reed switch, and an annular slider ring having ends of the shaft coupled to diametrically opposed points thereon such that the flywheel of the gyro assembly rotates about an axis which remains in substantially perpendicular relationship with an axis about which the slider ring is formed.

6. A golf swing aid system as set forth in claim 5 additionally comprising a magnetic slider mounted on the housing.

7. A golf swing aid system as set forth in claim 6 wherein the gyro assembly is removably situated in the housing and the reed switch of the gyro assembly is adapted to close upon the gyro assembly being situated in the proximity of the magnetic slider such that a user feels a sensation upon the golf club being swung improperly.

* * * * *